United States Patent [19]

Brancaz et al.

[11] 4,455,166

[45] Jun. 19, 1984

[54] NOZZLE FOR AN OXYGEN INJECTION LANCE FOR DECARBURIZATION OF PIG IRON AND USE FOR THE DECARBURIZATION OF CHROMIUM CONTAINING PIG IRON

[75] Inventors: Jean Brancaz, Venthon Albertville; Georges Marizy, Ugine, both of France

[73] Assignee: Ugine Aciers, Paris, France

[21] Appl. No.: 292,818

[22] Filed: Aug. 14, 1981

[30] Foreign Application Priority Data

Aug. 26, 1980 [FR] France ..... 80 18846

[51] Int. Cl.[3] ..... C21C 5/32

[52] U.S. Cl. ..... 75/60; 266/225; 266/265; 266/266; 266/217; 239/589

[58] Field of Search ..... 266/217, 225, 266, 218, 266/265; 75/60, 130.5; 239/589, 601

[56] References Cited

U.S. PATENT DOCUMENTS

| | | | |
|---|---|---|---|
| 2,175,160 | 10/1939 | Zobel et al. | 239/589 |
| 3,876,190 | 4/1975 | Johnstone et al. | 266/225 |
| 3,957,258 | 5/1976 | Carlomagno et al. | 266/225 |
| 4,324,584 | 4/1982 | Marizy | 75/60 |

*Primary Examiner*—L. Dewayne Rutledge
*Assistant Examiner*—Robert L. McDowell
*Attorney, Agent, or Firm*—Dennison, Meserole, Pollack & Scheiner

[57] ABSTRACT

A nozzle is disclosed for use in the decarburization of molten pig iron by means of a jet of oxygen from a lance provided with such nozzle. The nozzle according to the invention is characterized by a divergent portion which, beyond the neck, has a frustoconical part, with an apex angle of between 60° and 70° and preferably between 62° and 66°, and wherein an angle of 65° is preferred. The nozzle according to the invention can be used in particular for the decarburization of chromium containing pig iron and makes it possible to achieve very high chromium and iron yields.

7 Claims, 6 Drawing Figures

NOZZLE FOR AN OXYGEN INJECTION LANCE FOR DECARBURIZATION OF PIG IRON AND USE FOR THE DECARBURIZATION OF CHROMIUM CONTAINING PIG IRON

BACKGROUND OF THE INVENTION

1. Field of the Invention

The novel nozzle which is the subject of the present invention broadly concerns the decarburization of molten pig iron by means of lances which are disposed above the level of the molten pig iron and which emit a jet of oxygen through a nozzle towards the surface of the molten pig iron. The invention more particularly concerns the characteristics of the jets of oxygen which issue from injection lances provided with the novel nozzle and the influence of those characteristics on the conditions in respect of interaction between the oxygen jets and the liquid pig iron. While not limited thereto, the novel nozzle is used in particular for the decarburization of chromium containing pig iron.

2. Description of the Prior Art

A number of studies have been carried out in regard to the characteristics of nozzles which are mounted at the end of oxygen injection lances used for the decarburization of pig iron. Thus, in the work which concerns the metallurgy of steel, using basic converters, entitled "BOF Steelmaking", published in the United States in 1976 by the Iron and Steel Society, precise information is set out in Volume 3, chapter 8, pages 150 to 153, concerning the characteristics of the nozzles mounted on oxygen lances. It is stated in particular at lines 28 to 35 of page 150 that a reasonably uniform supersonic flow can be achieved by means of a simple divergent conical portion following the constriction. FIG. 8–5, on page 151 reproduces such an oxygen lance nozzle. Finally, lines 7 to 17 on page 153 set out precise information concerning the half-angle which should be adopted, at the apex of the divergent frustoconical portion. Excessively large angles must be avoided, as they reinforce the shock waves causing excessively rapid dispersion of the jet. It is proposed that the half-angle at the apex of the injection nozzle be selected to lie within the range of between 2.5° and 10°, a half-angle of 5° being considered a practical compromise.

Experience has shown that nozzles constructed in that manner give relatively satisfactory results in the general case of decarburization of ordinary pig iron but, in contrast, difficulties have been met when treating chromium containing pig iron and in particular when carrying out the decarburization process which is the subject of French patent application No. 80 01809 filed on 24.01.80 by UGINE ACIERS, and corresponding U.S. application Ser. No. 06/221,903, filed Dec. 31, 1980 in the name of Georges Marizy, now U.S. Pat. No. 4,324,584, Apr. 13, 1982, the disclosure of which is hereby incorporated by reference.

That application describes and claims a process for the decarburization of chromium or nickel-chromium pig iron containing from 1.5 to 8% by weight of C, from 10 to 30% by weight of Cr and up to 30% by weight of Ni, which includes, at least in the final phase of the decarburization operation, the formation of a gas/-molten pig iron emulsion within which carbon is directly oxidized by oxygen.

The conditions required for producing the above-mentioned emulsion are critical. Indeed, it is known that producing an emulsion as between a molten pig iron, a slag and a gaseous phase is a relatively simple matter. This is the case with decarburization of molten pig iron by the Linz-Donowitz (LD) process. It is the viscosity characteristics of the slag which play the most important part, as is demonstrated in the article by A. CHATTERJEE, N. O. LINDFOR and J. A. WESTER: "Process Metallurgy of LD Steelmaking", Iron Making and Steel Making 1976, No. 1. In contrast, in order that an emulsion between a gaseous phase and the molten pig iron can be formed and maintained in a stable manner, even in the virtually total absence of slag, until the carbon content is reduced down to a final level of close to 0.2%, it is necessary to have clearly defined conditions in respect of temperature of the molten pig iron, carbon content, lance-bath distance, and oxygen flow rate and pressure.

As described in French patent application No. 80 01809, when the favorable conditions are combined and the emulsion as between the gaseous phase and the molten pig iron is formed and satisfactorily maintained, the result is both rapid and extensive decarburization and at the same time a particularly high chromium metal yield. The examples given in the abovementioned application concern tests carried out on unitary quantities of chromium containing pig iron of about 60 kg. The nozzle used had a neck diameter of 2 mm and an oxygen flow rate of 168 Nl/min.

The studies undertaken and the many tests carried out for developing that chromium containing pig iron decarburization process have shown that it was not sufficient to suitably adjust the operating parameters which had been identified, in order to achieve the formation of a stable emulsion in a reproducible manner. In many situations, delays in the formation of the emulsion and a certain degree of instability of the emulsion were noted; such delays and/or instability resulted in a drop in the chromium and iron yields. In some cases even, no emulsion at all was formed.

A way of improving the reproducibility of initiation of the formation of the gas/molten pig iron emulsion, and also increasing the stability of the emulsion, once formed was therefore sought.

SUMMARY OF THE INVENTION

The means forming the subject matter of this invention is a novel nozzle means for providing a supersonic oxygen jet from an injection lance, by which it is possible to cause the formation of the gas/molten pig iron emulsion, with a much higher degree of efficiency.

The novel nozzle according to the invention is characterized by a divergent portion which, beyond the neck or constriction, comprises a frustoconical part in which the apex angle is between 60° and 70° and preferably between 62° and 66°, the angle of 65° being close to the optimum under the conditions of the tests. The frustoconical part may be extended by a surface of revolution about the same axis, the generatrix of which has an inwardly directed concavity so as to reduce the degree of dispersion of the jet.

The novel nozzle according to the invention makes it possible for the process of decarburizing chromium-containing pig iron by a supersonic oxygen jet, which process is the subject of French patent application No. 80 01809, to be carried out in a particularly effective manner.

The novel nozzle according to the invention is also applied in a much broader manner to the decarburization of pig iron of all types, by virtue of a particular degree of efficiency, for causing the formation of an emulsion of the liquid phase by means of the gaseous phase and possibly also an emulsion with the molten slag.

Additional Description of the Prior Art

In the first of a series of chromium containing pig iron decarburization tests, using the process described in French patent application No. 80 01809, use was made of an oxygen lance comprising a prior art nozzle, the constriction or neck of which was formed by a cylindrical tubular region of about 2 mm in diameter and 20 mm in length. The end of the tubular region, at the outlet end, was not extended by a divergent portion and expansion of the oxygen jet was therefore absolutely not limited at the outlet from constriction.

Experience had shown that, under those conditions, the nozzle became covered with a layer of chromium oxide-based refractory oxides. That layer was deposited primarily during the period of forming and then maintaining the gas/molten pig iron emulsion.

Analysis of such a layer gave for example the following composition:

$Cr_2O_3$: 50% (by weight)
FeO: 20%
$SiO_2$: 10%
$Al_2O_3$: 7%
MgO: 6%
CaO: 6%

It will be seen that the above-mentioned layer was formed essentially by the oxidation of the components of the chromium containing pig iron, with the intervention of only a few percent of lime coming from the slag which was initially introduced, and wherein alumina and magnesia came from the lining. It was found that this layer had a tendency to surround the orifice of the nozzle and to form a more or less clearly defined funnel configuration around the nozzle orifice.

Figure 1:
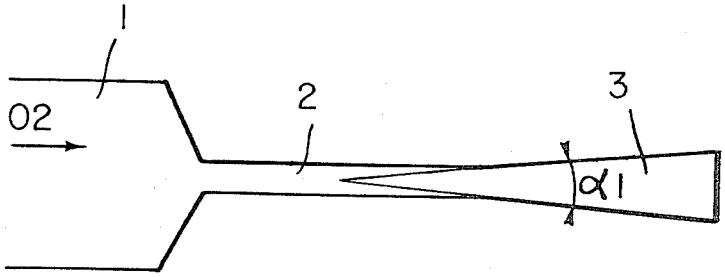
PRIOR ART FIG. 1
FIG. 1 shows a prior art nozzle of the type for providing a supersonic oxygen jet.

The idea was conceived of designing a nozzle having a divergent portion, both in order to try to improve the efficiency of the jet and also to avoid the dangers of disturbing the jet by deposits of refractory oxides deposited by projection from the molten pig iron. Nozzles of the general configuration shown in FIG. 1 were then designed. These nozzles comprise an inlet 1 connected to the oxygen intake duct, then a cylindrical neck 2 which is about 2 mm in diameter and 20 mm in length and finally, a frustoconical divergent portion 3, the apex angle $\alpha$ 1 of which is about 10° in accordance with the teaching of the above-mentioned BOF Steelmaking article.

The test results with such nozzles were negative. It was found in fact that no layers of oxides were deposited within the divergent portion, but that there was no success in forming the gas/molten pig iron emulsion in a reproducible and stable manner.

DESCRIPTION OF THE PREFERRED EMBODIMENTS

The Examples taken together with the drawings, provide for better understanding of the structure and characteristics of the nozzle of this invention, and the application thereof for the decarburization of chromium containing pig iron.

Figure 2:
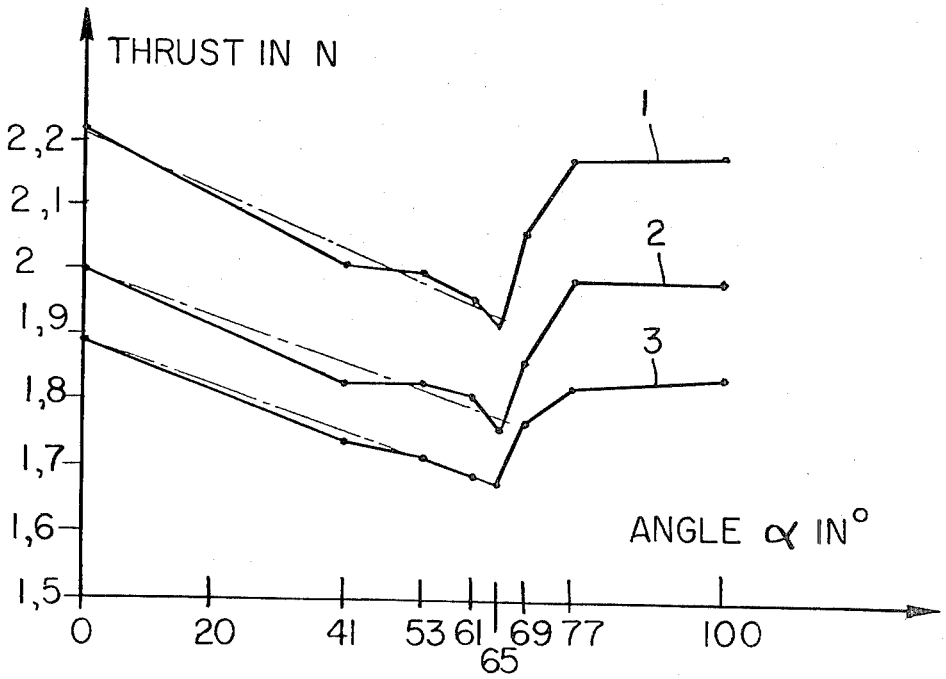
FIG. 2 is a graph showing the variation in the thrust of the jet depending upon the angle at the apex of the divergent portion of a frustoconical nozzle.

Tests were then carried out in order to identify in particular the influence of the angle at the apex of the frustoconical divergent portion on the thrust of the jet at a constant flow rate. FIG. 2 gives the results of such tests in the case of a series of eight nozzles having the general characteristics as those in FIG. 1, except for the angle of the divergent portion. Nozzle No. 1 did not have any divergent portion, while nozzles 2, 3, 4, 5, 6, 7 and 8 had frustoconical divergent portions which were 4 mm in height and whose apex angles were respectively 41°, 53°, 61°, 65°, 69°, 77° and 100°.

Three series of tests were carried out, with these different levels of oxygen flow rate: 172, 181 and 193 Nl/min. For each test, the thrust force in N applied by the jet to the pan of a balance disposed at a spacing of about 3 cm from the orifice was measured.

Curves 1, 2 and 3 which are respectivey drawn for flow rates of 193, 181 and 172 Nl/min show in each case the existence of the same singular point when using the 65° divergent portion.

Although that singular point corresponds to a minimum thrust level, the idea was conceived of designing in accordance with the invention nozzles for the decarburization of pig iron using a supersonic oxygen jet, comprising a frustoconical divergent portion, the apex angle of which is between 60° and 70° and preferably between 62° and 66°, the angle of 65° corresponding, within the accuracy of the measurements made, to the minimum thrust force, under the test conditions.

Figure 3:
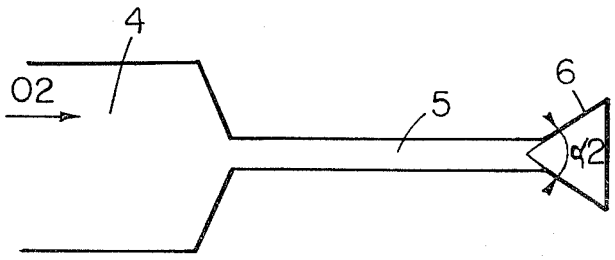
FIG. 3 shows an embodiment of a nozzle for a supersonic oxygen jet in accordance with the invention.

FIG. 3 shows a nozzle in accordance with the invention. It comprises an inlet 4 and a neck 5, the characteristics of which are similar to those of the inlet 1 and the neck 2 in FIG. 1. On the other hand, the frustoconical divergent portion 6 has an apex angle $\alpha$ 2 of 65°. It was found that it is possible, when using such a nozzle, to produce in an entirely reproducible manner an emulsion of chromium containing pig iron by means of a supersonic oxygen jet, in accordance with the process described in the above-referenced French patent application. In addition, once that emulsion has formed, it has a high degree of stability and is maintained until final decarburization of the pig iron, that is to say, until the carbon content is close to 0.2%. Although this cannot be affirmed, and we do not wish to be limited by this statement of theory, it is possible that the particular efficiency of divergent portions with an angle of from 60° to 70° and preferably between 62° and 66° is due to the particularly substantial amount of turbulence caused in the flow of oxygen by that form of divergent configuration.

The influence of the apex angle of the divergent portion on the mean yields in respect of Cr and Fe in the decarburization operation was then studied. Tests had in fact shown that, generally speaking, a high level of stability in respect of formation and maintenance of the gas/molten pig iron emulsion was accompanied by very high yields in respect of Fe and Cr. These yields are calculated in % by weight, relating the amounts of Fe and Cr contained in the steel produced after decarburization to those amounts initially contained in the pig iron.

The example hereinafter gives the results of a series of pig iron decarburization tests which were carried out in an identical manner, with the only variation being in respect of the angles of divergence of the nozzles.

A series of six nozzles, of the same type as that shown in FIG. 3 but each having a different apex angle in the frustoconical divergent portion, was prepared. The six apex angles which were thus produced are: 41°, 53°, 61°, 65°, 69° and 77°. Each of the nozzles comprises a cylindrical neck which is 2 mm in diameter and 20 mm in length, and the height of the truncated cone of the divergent portion is 4 mm in all cases.

Using each of these nozzles, three to nine chromium containing pig iron decarburization tests were effected, using a single mode of operation similar to that already described in French patent application No. 80 01809.

A homogenous pig iron batch was prepared, of the following compostiion: Cr 17%, C 6%, Si 0.3%, Mn 0.3%, S<0.03%, P<0.03%.

For each test, an amount of 60 kg of the aboveindicated pig iron is raised to a temperature of 1380° C. in a furnace utilizing induction heating, the surface of the molten pig iron being covered with 340 g of lime. Oxygen is then injected by means of a vertical lance, at a flow rate of about 180 Nl/min. One of the six nozzles described above is used, and the vertical distance between the end of the nozzle and the bath is 26 mm. The oxygen which is thus ejected enters into reaction with the bath, and three successive phases may be observed.

In a first phase, the oxygen reacts primarily at the surface of the molten pig iron preferably oxidizing Cr, Si and Fe. As the oxides formed, which contain a majority proportion of $Cr_2O_3$, accumualate at the surface of the bath, a secondary reaction of reduction of those oxides by carbon commences. The speed of the reduction reaction gradually increases at the same time as the temperature rises, to about 1650° C., at about the tenth minute. The CO formed is given off during that period, and burns, producing flames.

In a second phase, starting from the eleventh minute, the reduction of the oxides, primarily chromium oxide, by carbon, becomes more rapid than the speed at which those oxides are formed. In that period of vigorous reaction, the temperature rises further, but less quickly. As from about the fifteenth minute, the speed of decarburization stabilizes, the carbon content which is then about 4% continues to fall at a rate of approximately 0.3% per minute and at the same time, a corresponding reduction of the chromium oxide is observed. This mechanism continues until about the twentieth minute: the temperature of the bath then reaches about 1750° C. while the C content has fallen to about 2.9%. At the end of this second phase, the metal oxides which were initially formed are almost completely reduced.

At about the twentieth minute, there is the combination of conditions for initiating a third phase which will permit the carbon content to be reduced to about 0.2%. At the beginning of the third phase, the temperature of the molten pig iron is very high. Under these conditions, with the conditions in respect of oxygen flow rate and distance between the end of the nozzle and the molten pig iron being maintained unchanged, it is observed that from the molten pig iron itself, an emulsion is formed between the gas and the molten pig iron which emulsion rapidly covers the surface of the molten pig iron and then develops in thickness, as far as doubling the initial volume of the molten pig iron.

The process involved is as if the pig iron itself, under the action of the jet of oxygen and the formation of CO, by direct reaction of the oxygen with the carbon contained in the pig iron, passed into a condition of boiling throughout its mass, by virtue of the physical-chemical conditions produced. Within the emulsion which is thus formed, the reaction speeds are high, which makes it possible to continue decarburization at a rapid rate down to a final carbon content of about 0.2%, which is reached in the twenty-ninth minute. The temperature is then about 1820° C., and the oxygen blast is stopped.

Weighing the steel produced after solidification and analysis of the iron and chromium content thereof make it possible to determine the corresponding Fe and Cr yields.

Figure 4:
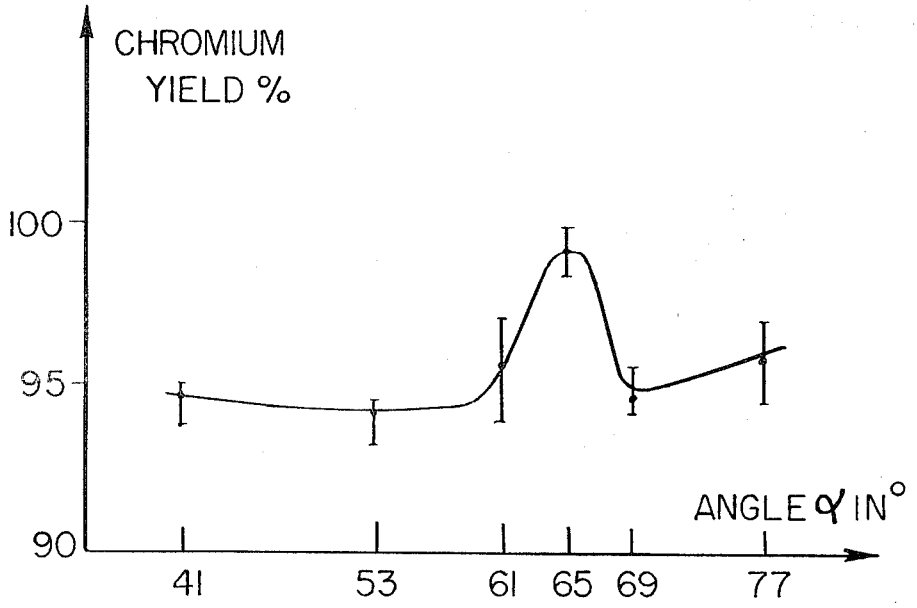
FIG. 4 is a graph showing the variation in the chromium yield in depending upon the apex angle of the frustoconical divergent portion of the nozzle.
Figure 5:
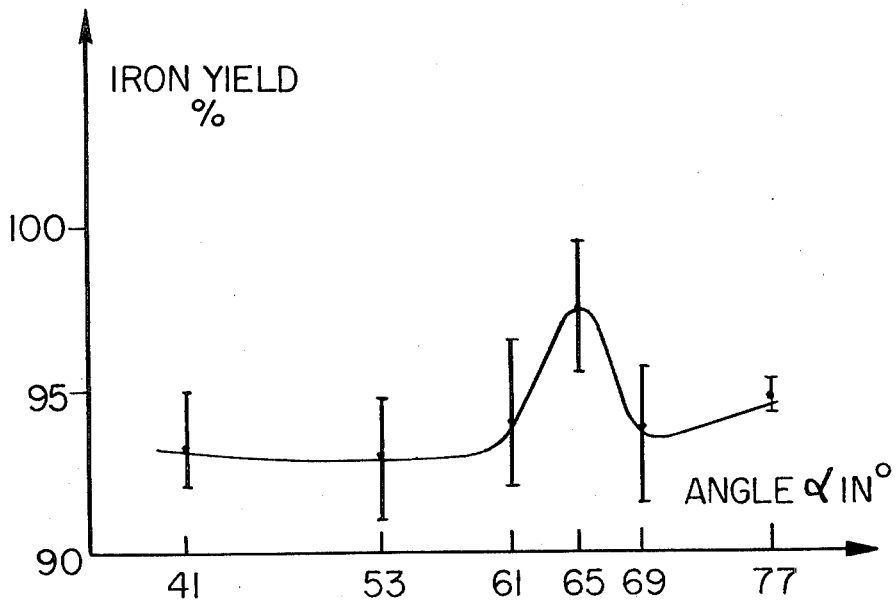
FIG. 5 is a graph showing the variation in the iron yield depending upon the above-mentioned apex angle.

FIGS. 4 and 5 show the variation in the Fe and Cr yields, in dependence on the angle of the frustoconical divergent portion of the nozzle. It will be very clearly seen that the yields pass through a maximum with the nozzle which has an angle of 65°. Although certain factors may slightly modify the optimum angle of the frustoconical divergent portion according to the invention, that angle, from the tests carried out, is between 62° and 66° in the range of operating conditions which can be used.

With a nozzle having a 65° apex angle, the deposits on the inside wall surface of the nozzle, due to refractory oxides being splashed up from the molten metal, are small.

Complementary tests have shown that it is possible further to reduce such deposits, and also to reduce the degree of dispersion of the jet, by extending the frustoconical part of the divergent portion by a surface of revolution about the same axis, the generatrix of which has an inwardly directed concavity. It is preferably appropriate for the tangent to the generating curve of that part of the nozzle to coincide at the origin with the generatrix of the cone. At the end of the generating curve, the tangent may extend parallel to the axis, or close to a condition of parallelism.

Figure 6:
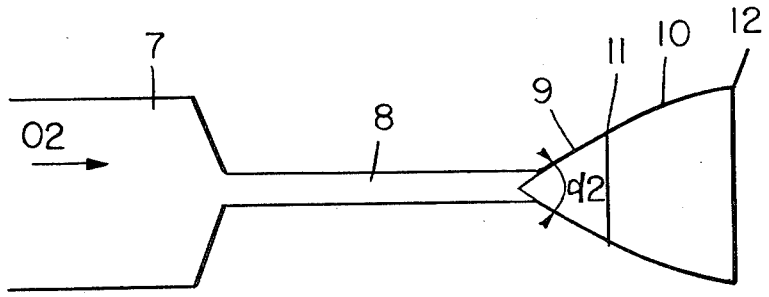
FIG. 6 shows an alternate embodiment of a nozzle according to the invention.

FIG. 6 shows an alternate embodiment of a preferred nozzle according to the invention, which is configured in the above-indicated manner. FIG. 6 shows the inlet 7, the cylindrical neck 8 and the frustoconical divergent portion 9 with the apex angle $\alpha$ 2, which are similar to the corresponding parts of the nozzle in accordance with the invention as shown in FIG. 3. The part 10 which extends the frustoconical portion 9 has a concavity which is directed towards the axis. At the point 11 of connection between the truncated cone and the part 10, the tangent to the generatrix of the part 10 coincides with the generatrix of the truncated cone. At point 12, at the end of the nozzle, the tangent to the generatrix of the concave part is almost parallel to the axis of the nozzle. The preferred nozzle of this invention, has the considerable advantage, by virtue of the shape of its outlet end, of eliminating the dangers of penetration of projected oxides or even metal from the molten metal bath. As said earlier, the angle $\alpha$ 2 is comprised between 60° and 70° and preferably between 62° and 66°, the optimum being near 65° under the test conditions.

The nozzle according to the invention may be made of various materials. It is often preferable to use copper. It is important for the inside surfaces to be suitably machined and for them to have a smooth surface in order to avoid projected particles of oxides or metal sticking thereto. In general, the nozzle is connected in a conventional manner to a metal lance which is cooled by a suitable fluid.

Although the examples set out above relate to tests carried out on small amounts, it has been verified by computer model that the results obtained can be extrapolated to the industrial scale. Thus, the apex angles of the frustoconical divergent portions according to the invention also give optimum results in the case of large-section nozzles which are used for treating pig iron in industrial amounts.

In addition, although the nozzle in accordance with this invention was tested primarily in regard to the decarburization of chromium containing pig iron tests have shown that it could be used as advantageously for the decarburization of all types of pig iron.

Thus, in the broadest aspect, it is possible to use oxygen lances provided with nozzles according to the invention for the decarburization of pig iron in a basic converter using processes such as the LD process or similar processes.

In these various situations, the use of nozzles according to the invention makes it possible to enhance the efficiency and the speed of decarburization, and also make it possible to increase the yield of iron.

We claim:

1. A supersonic oxygen jet nozzle having inlet and outlet portions, said outlet portion having a frustoconical divergent outlet having an apex angle of between 60° and 70° and said divergent outlet comprising means for establishing a supersonic substantially turbulent oxygen jet for effecting formation of a gas-molten pig iron emulsion.

2. The nozzle according to claim 1 wherein the frustoconical divergent portion has an apex angle of between 62° and 66°.

3. The nozzle according to claim 1, including outwardly of the frustoconical divergent portion of the nozzle, means providing a surface of revolution about the same axis, the generating curve of which has an inwardly directed concavity.

4. The nozzle according to claim 2, including outwardly of the frustoconical divergent portion of the nozzle, means providing a surface of revolution about the same axis, the generating curve of which has an inwardly directed concavity.

5. The nozzle according to claim 1 wherein the frustoconical divergent has an apex angle of about 65°.

6. In a process for the decarburization of chromium containing molten pig iron including the step of subjecting the molten pig iron to a supersonic oxygen jet, the improvement comprising providing said oxygen jet by utilization of the nozzle of claims 1, 2, 3, 4 or 5.

7. In a process for the decarburization of chromium containing molten pig iron including the step of subjecting the molten pig iron to a supersonic oxygen jet, for the formation of stable gas-molten pig iron or gas-slag-molten pig iron emulsions, the improvement comprising providing said oxygen jet by utilization of the nozzle of claims 1, 2, 3, 4 or 5.

* * * * *